US011884375B2

(12) United States Patent
Neathery et al.

(10) Patent No.: US 11,884,375 B2
(45) Date of Patent: Jan. 30, 2024

(54) MULTI-LAYER GEAR DETERMINATION SYSTEM

(71) Applicant: Caterpillar Inc., Peoria, IL (US)

(72) Inventors: Brian P. Neathery, Hockley, TX (US); Cameron S. Gandy, Houston, TX (US)

(73) Assignee: Caterpillar Inc., Peoria, IL (US)

( * ) Notice: Subject to any disclaimer, the term of this patent is extended or adjusted under 35 U.S.C. 154(b) by 232 days.

(21) Appl. No.: 17/375,479

(22) Filed: Jul. 14, 2021

(65) Prior Publication Data

US 2023/0014852 A1 Jan. 19, 2023

(51) Int. Cl.

| | |
|---|---|
| ***B63H 21/21*** | (2006.01) |
| ***B63B 79/40*** | (2020.01) |
| ***B63B 79/10*** | (2020.01) |
| ***B63H 23/02*** | (2006.01) |
| ***B63H 23/04*** | (2006.01) |

(52) U.S. Cl.

CPC ..... *B63H 21/213* (2013.01); *B63B 79/10* (2020.01); *B63B 79/40* (2020.01); *B63H 23/02* (2013.01); *B63H 23/04* (2013.01); *B63H 2021/216* (2013.01); *B63H 2023/0208* (2013.01)

(58) Field of Classification Search

CPC ..... B63H 21/213; B63H 21/21; B63H 23/02; B63H 23/04; B63H 2021/216; B63H 2023/0208; B63B 79/40; B63B 79/10

See application file for complete search history.

(56) References Cited

U.S. PATENT DOCUMENTS

| | | | |
|---|---|---|---|
| 6,293,838 | B1 | 9/2001 | Ferguson |
| 6,420,799 | B1 | 7/2002 | Sakamoto et al. |
| 7,143,363 | B1 | 11/2006 | Gaynor et al. |
| 7,931,513 | B2 | 4/2011 | Suzuki et al. |
| 8,224,512 | B1 | 7/2012 | Dengel et al. |
| 9,097,344 | B2 | 8/2015 | Hoff et al. |

(Continued)

FOREIGN PATENT DOCUMENTS

| | | | |
|---|---|---|---|
| CN | 100535483 | C | 9/2009 |
| EP | 3608215 | A1 | 2/2020 |
| WO | 2020246045 | A1 | 12/2020 |

OTHER PUBLICATIONS

Written Opinion and International Search Report for Int'l. Patent Appln. No. PCT/US2022/036748, dated Nov. 15, 2022 (11 pgs).

*Primary Examiner* — Stephen P Avila

(57) ABSTRACT

A marine propulsion control system for use with a marine vessel includes an engine in electronic communication an engine controller, and a transmission having a gearbox and an oil pressure sensor in electronic communication with the engine controller and configured to measure a transmission oil pressure. The gearbox includes a feedback sensor configured to transmit a gear state. A propulsion device is rotatably connected to the gearbox, and a shaft fixedly attached to the propulsion device and rotatably coupled to the gearbox. The shaft includes a shaft rotation sensor configured to measure a rotational direction of the shaft. A propulsion control processor is in electronic communication with the engine controller, the shaft rotation sensor and the gearbox, and is configured to determine a current gear of the marine vessel based on the rotational direction of the shaft and one or more of the gear state and the transmission oil pressure.

20 Claims, 4 Drawing Sheets

(56) References Cited

U.S. PATENT DOCUMENTS

| | | | | |
|---|---|---|---|---|
| 9,802,688 | B1 | 10/2017 | Tuchscherer et al. | |
| 2004/0064224 | A1 | 4/2004 | Hasler et al. | |
| 2005/0092225 | A1* | 5/2005 | Kaji | B63H 25/42 114/144 R |
| 2019/0338718 | A1 | 11/2019 | Buis | |
| 2020/0324868 | A1* | 10/2020 | Gonring | H04W 4/021 |

* cited by examiner

MULTI-LAYER GEAR DETERMINATION SYSTEM

TECHNICAL FIELD

The present disclosure relates to a marine propulsion control system and, more particularly, to a multi-layered system and method for determining a current gear of a marine vessel.

BACKGROUND

Marine vessels may be used in a variety of applications to provide transportation in waterways, such as oceans, lakes, rivers, and/or the like. Typical marine vessels include a number of operator control stations outfitted with various devices for controlling steering and propulsion of the vessel. In normal operation of the marine vessel, for example, an operator may wish to maneuver the vessel by moving a port or starboard lever into a forward, reverse or neutral gear. However, simply moving the port or starboard lever may not automatically change the gear of the vessel. Marine vessel propulsion systems typically require a series of thresholds and checks to be met or completed before actually changing gears. To complete these thresholds and enable the commanded gear change, the marine vessel propulsion system needs to accurately determine the current transmission gear.

Current marine propulsion control systems rely on gear feedback indicators installed in a transmission gearbox during manufacture to determine the current gear of a marine vessel. The type and number of indicators installed, however, vary by manufacturer, and are typically limited in the information they provide, often only providing information about the non-neutral state of the transmission, such as forward or reverse. While that information may certainly be utilized by marine vessel propulsion systems, relying solely on that indicator feedback may pose difficulties in operation and system diagnostics as the quality and reliability of the indicators decreases.

Prior attempts at determining a current gear of a marine vessel have been directed to systems that rely on examining mechanical clutch positions. For example, U.S. Pat. No. 7,931,513 discloses a position switching mechanism that switches between forward, reverse and neutral positions by operation of a first and second hydraulic clutch. Namely, the position switching mechanism is in a "forward" position when the first hydraulic clutch is engaged and the second hydraulic clutch is disengaged. Similarly, the position switching mechanism is in a "reverse" position when the first hydraulic clutch is disengaged and the second hydraulic clutch is engaged. Finally, the position switching mechanism is in a "neutral" position when the first and second hydraulic clutches are disengaged.

There is consequently a need for a multi-layer system for determining a current gear of the marine vessel.

SUMMARY

In accordance with one aspect of the present disclosure, a marine propulsion control system for use with a marine vessel is disclosed. The marine propulsion control system may include an engine in electronic communication with an engine controller, and a transmission including a gearbox and an oil pressure sensor in electronic communication with the engine controller and configured to measure a transmission oil pressure. The gearbox may include a feedback sensor configured to transmit a gear state. The marine propulsion control system may further include a propulsion device rotatably connected to the gearbox, and a shaft fixedly attached to the propulsion device and rotatably coupled to the gearbox. The shaft may include a shaft rotation sensor configured to measure a rotational direction of the shaft. The marine propulsion control system may further include a propulsion control processor in electronic communication with the engine controller, the shaft rotation sensor and the gearbox, and may be configured to determine a current gear of the marine vessel based on the rotational direction of the shaft and one or more of the gear state and the transmission oil pressure.

In accordance with another aspect of the present disclosure, a marine vessel is disclosed. The marine vessel may include a hull, an operator station and a marine propulsion control system. The marine propulsion control system may include an engine in electronic communication with an engine controller and a transmission including a gearbox and an oil pressure sensor configured to measure a transmission oil pressure. The oil pressure sensor may be in electronic communication with the engine controller, and the gearbox may include a feedback sensor configured to transmit a gear state. The marine propulsion control system may further include a propulsion device rotatably connected to the gearbox, and a shaft fixedly attached to the propulsion device and rotatably coupled to the gearbox. The shaft may include a shaft rotation sensor configured to measure a rotational direction of the shaft. The marine propulsion control system may further include a propulsion control processor in electronic communication with the engine controller, the gearbox and the shaft rotation sensor and configured to receive the transmission oil pressure, the gear state of the transmission and the rotational direction of the shaft. The propulsion control processor may be configured to compare the transmission oil pressure with a predetermined engaged pressure threshold, such that when the transmission oil pressure is greater than the predetermined engaged pressure threshold, the propulsion control processor may analyze one or more of the gear state and the direction of rotation to determine a current gear of the marine vessel. Similarly, when the transmission oil pressure is less than or equal to the engaged pressure threshold, the propulsion control processor may compare the transmission oil pressure with a predetermined disengaged pressure threshold, such that when the transmission oil pressure is greater than or equal to the transmission disengaged pressure threshold, the propulsion control processor may analyze one or more of the gear state and the direction of rotation to determine the current gear of the marine vessel.

In accordance with yet another aspect of the present disclosure, a method of determining a current gear of a marine vessel is disclosed. The marine vessel may include a transmission and a propulsion control processor to execute the method. The method may comprise determining whether a transmission oil pressure sensor is enabled or disabled; receiving, if the transmission oil pressure sensor is enabled, an oil pressure; determining if a feedback sensor is installed in a gearbox of a transmission of the marine vessel; receiving, if the feedback sensor is installed, a gear state of the transmission; determining if a shaft rotational direction sensor is installed on a shaft of a propulsion device of the marine vessel; receiving, if the shaft rotational direction sensor is installed, a direction of rotation of the shaft; and receiving a commanded gear, the commanded gear being set by an operator of the marine vessel. Upon receipt of the oil pressure, the gear state, the direction of rotation of the shaft and the commanded gear, the propulsion control processor may first compare the oil pressure with a predetermined pressure threshold to determine whether the current gear is neutral or one of forward and reverse. Then, the propulsion control process may compare one or more of the gear state, the direction of rotation, and the commanded gear, based on the first comparison, to determine whether the current gear is one of neutral, forward and reverse.

These and other aspects and features of the present disclosure will be better understood upon reading the following detailed description, when taken in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
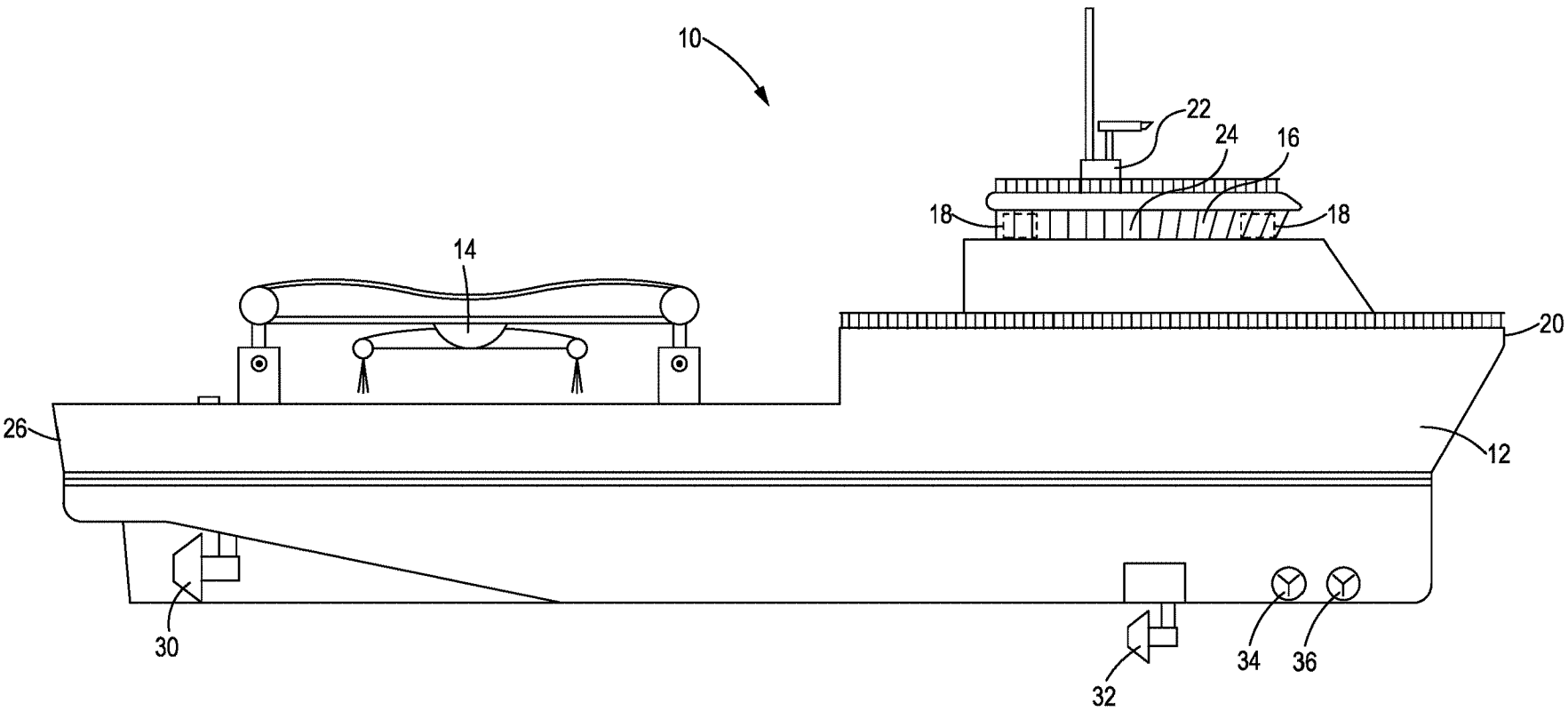
FIG. 1 is a side elevation view of a marine vessel in accordance with an embodiment of the present disclosure.

FIG. 1 illustrates a side elevation view of a marine vessel 10, according to an embodiment of the present invention. The exemplary marine vessel 10, as illustrated, may be an anchor handling tug supply vessel, although the term "marine vessel" may refer to any marine vessel that performs an operation associated with an industry such as, for example, recreation, fishing, transportation, shipping, and/or the like. As some examples, the marine vessel may be a power boat, a sail boat (with a marine propulsion system), a hovercraft, an air boat, an amphibious vehicle, a submarine, or another type of vehicle that is capable of traversing a waterway, such as an ocean, lake, river, and/or the like.

The marine vessel 10 may include a hull 12, a bridge 16, and one or more implements, such as a crane 14. The marine vessel 10 may also include at least one operator station 18, such as a main helm operator station, for example, that may be centrally located on the bridge 16 and generally oriented so an operator may face a bow 20 of the marine vessel. Up to seven additional operator stations may be located at redundant sites throughout the marine vessel 10, such as, for example, in a tower control station 22, on one or more fly bridges 24, at a rear of the bridge 16 but generally oriented toward a stern 26 of the marine vessel, or proximate the stern of the marine vessel, among other locations. While exemplary positions of the operator stations 18 have been described herein with respect to FIG. 1, it should be understood that the operator stations may be located anywhere on the marine vessel 10, and up to eight operator stations may be supported by the present disclosure. Each operator station 18 may include a leverhead control station 40 (see FIGS. 2 and 3) along with other controls that may be used to control a plurality of propulsion mechanisms 28, 30, 32, 34, 36 for propelling the marine vessel 10 during transit, such as while travelling between locations, and during dynamic positioning and/or other short maneuvers.

As illustrated, the marine vessel 10 may include, for example, a port powertrain 28 (FIG. 2), a starboard powertrain 30, a bow thruster 32, and ancillary bow thrusters 34, 36. The port powertrain 28 and starboard powertrain 30 may provide the main propulsive power when the marine vessel 10 is in transit, and may be located at, adjacent to or towards the stern 26 of the marine vessel. The port powertrain 28 may be positioned proximate a port side of the marine vessel 10, while the starboard powertrain 30 may be positioned proximate the starboard side of the marine vessel. The bow thruster 32 and ancillary bow thrusters 34, 36 may be utilized for performing short maneuvers, such as docking, and may be aligned with each other and along a center of the marine vessel 10.

Figure 2:
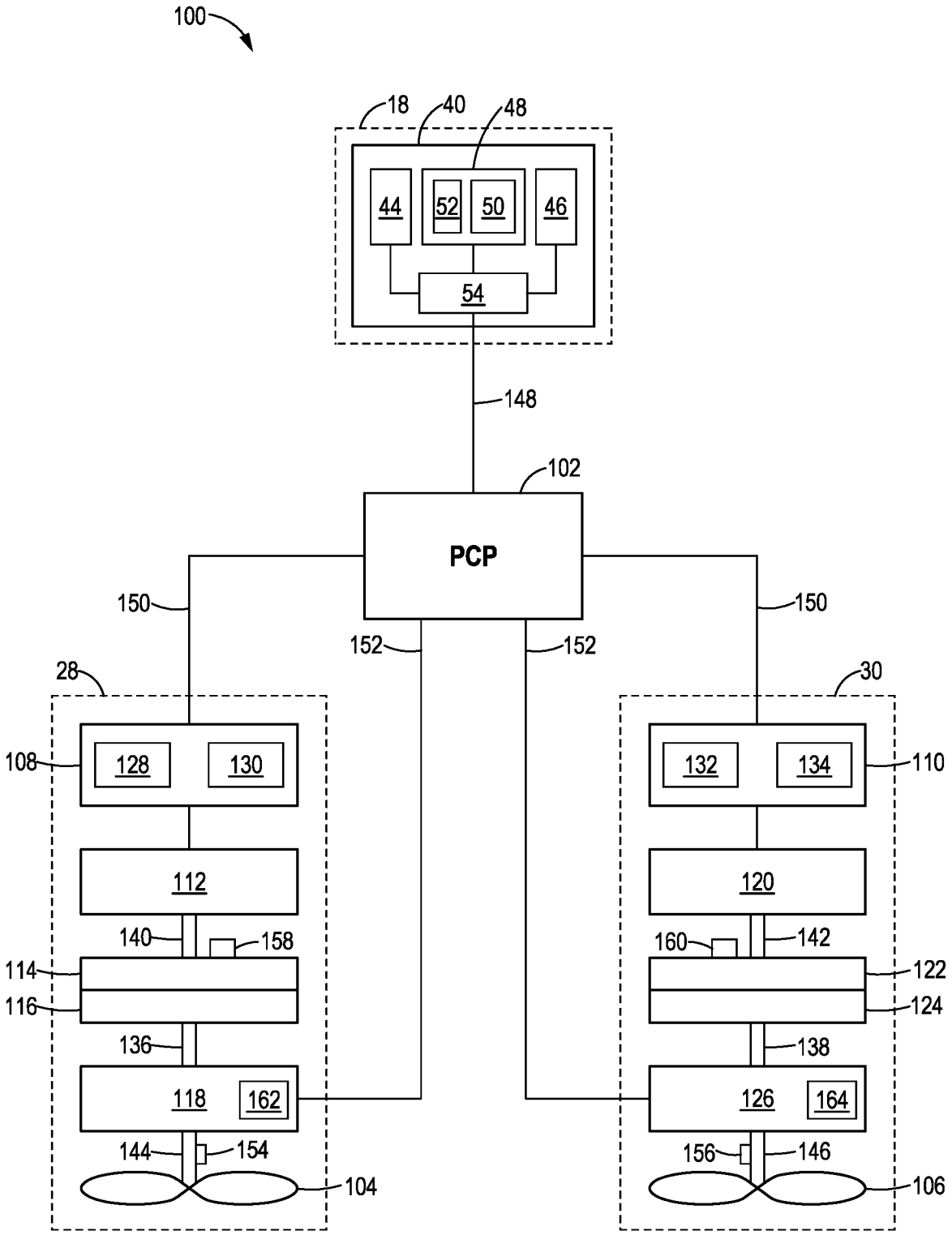
FIG. 2 is a schematic representation of an exemplary embodiment of a marine propulsion control system according to the present disclosure.
Figure 3:
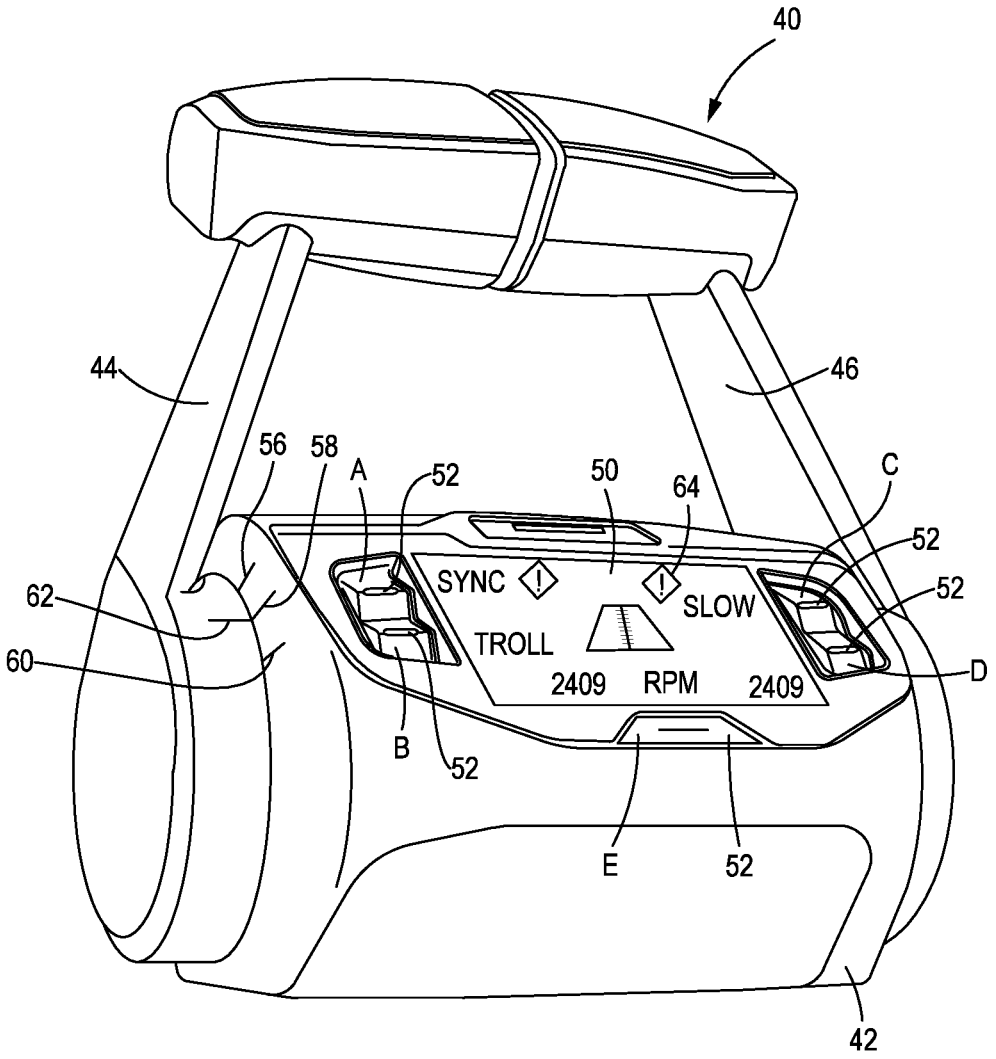
FIG. 3 is a perspective view of a control station according to an embodiment of the present disclosure.

Referring now to FIGS. 2 and 3, the marine vessel 10 may further include a marine propulsion control (MPC) system 100. The MPC system 100 may include a propulsion control processor (PCP) 102, which may be the primary processor for the MPC system. The PCP 102 may be a processor (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software that may interpret and/or execute information and/or instructions stored within a memory (not shown) to perform one or more functions. The memory may include a random access memory ("RAM"), a read only memory ("ROM"), and/or another type of dynamic or static storage device (e.g., a flash, magnetic, or optical memory) that stores information and/or instructions for use by the example components, including the information and/or instructions used by the PCP 102. Additionally, or alternatively, the memory may include non-transitory computer-readable medium or memory, such as a disc drive, flash drive, or the like. The PCP 102 may access information and/or instructions stored in the memory in one or more data structures, such as one or more databases, tables, lists, trees, etc.

As noted above, the MPC system 100 may support at least one operator station 18, and up to eight operator stations, each with its own leverhead control station 40. In the illustrated embodiment, the MPC system 100 is a parallel propulsion system including the port powertrain 28, and the starboard powertrain 30 arranged in parallel. In alternative embodiments, the MPC system 100 may not be a parallel propulsion system, and may include more or less than two stern powertrains. Furthermore, as illustrated, the starboard powertrain 30 may include the same components as the port powertrain 28. In other embodiments, however, the port powertrain 28 and the starboard powertrain 30 may include one or more differing components.

The port powertrain 28 may include a port side engine 112 that may be electronically coupled to a port side engine electronic control module (ECM) 108. The port powertrain 28 may further include a port side clutch 114, a port side motor-generator 116, a port side gearbox 118, and a port side propulsion device 104, arranged in series. As used herein, a port side transmission may include at least the port side clutch 114, the port side motor-generator 116 and the port side gearbox 118. The port side engine 112 may drive a port side output shaft 136 via a port side input shaft 140 and the clutched connection via the port side clutch 114 to the port side motor-generator 116. The port side clutch 114 may provide the clutched connection such that the port side motor-generator 116 may be fixed for rotation with the port side output shaft 136, and not with the port side input shaft 140. The port side propulsion device 104 may be a propeller connected to the other components of the port powertrain 28 by a port side propeller shaft 144. The port side propeller shaft 144 may be connected to port side output shaft 136 via the port side gearbox 118. The port side propeller shaft 144 may include a port shaft sensor 154 that may measure at least the speed and the rotational direction of the port side propeller shaft. The port shaft sensor 154 may be in electronic communication with the PCP 102 to enable transmission of the speed and rotational direction data to the PCP. In addition, the port side clutch 114 may include a port transmission oil pressure sensor 158 for measuring the pressure of transmission oil within the port side clutch. The port transmission oil pressure sensor 158 may be positioned on, within, or proximate to a transmission oil line (not shown) associated with the port side clutch 114, and may be electronically coupled to the port side engine ECM 108. The analog data sensed by the port transmission oil pressure sensor 158 may be transmitted to the port side engine ECM 108, which may generate and transmit a port transmission oil pressure value to the PCP 102 based on the received data.

The starboard powertrain 30 may include a starboard side engine 120 that may be electronically coupled to a starboard engine ECM 110. The starboard powertrain 30 may further include a starboard side clutch 122, a starboard side motor-generator 124, a starboard side gearbox 126, and a starboard side propulsion device 106, arranged in series. As used herein, a starboard side transmission may include at least the starboard side clutch 122, the starboard side motor-generator 124 and the starboard side gearbox 126. The starboard side engine 120 may drive a starboard side output shaft 138 via a starboard side input shaft 142 and a clutched connection via the starboard side clutch 122 to the starboard side motor-generator 124. The starboard side clutch 122 may provide the clutched connection such that the starboard side motor-generator 124 may be fixed for rotation with the starboard side output shaft 138, not with the starboard side input shaft 142. The starboard side propulsion device 106 may be a propeller connected to the other components of the starboard powertrain 30 by a starboard side propeller shaft 146. The starboard side propeller shaft 146 may be connected to starboard side output shaft 138 via the starboard side gearbox 126. The starboard side propeller shaft 146 may include a starboard shaft sensor 156 that may measure at least the speed and the rotational direction of the starboard side propeller shaft 146. This data may be transmitted to the PCP 102. The starboard shaft sensor 156 may be in electronic communication with the PCP 102 to enable transmission of the speed and rotational direction data to the PCP. Furthermore, the starboard side clutch 122 may include a starboard transmission oil pressure sensor 160 for measuring the pressure of transmission oil within the starboard side clutch. The starboard transmission oil pressure sensor 160 may be positioned on, within, or proximate to a transmission oil line (not shown) associated with the starboard side clutch 122, and may be electronically coupled to the starboard side engine ECM 110. Data sensed by the starboard transmission oil pressure sensor 160 may be transmitted to the starboard side engine ECM 110, which may then generate and transmit a starboard transmission oil pressure value to the PCP 102 based on the received data.

The port side engine 112 and the starboard side engine 120 may be configured in a variety of ways. Any suitable power source capable of driving the propulsion devices 104, 106 may be used. Suitable power sources may include, but not be limited to, reciprocating engines, such as diesel, gaseous (e.g. liquified natural gas), gasoline, or dual fuel engines, and turbines, such as steam, gas or nuclear-powered steam turbines. The size and configuration of the power source may also vary in different embodiments. In the illustrated embodiment, the port and starboard side engines 112, 120 are internal combustion diesel engines. Furthermore, in the illustrated embodiment, the port and starboard powertrain 28, 30 each include a single gearbox 118, 126; however, in alternative embodiments, multiple gearboxes on each of the port and starboard powertrain may be included. Each gearbox 118, 126 may be electronically coupled to the PCP 102, and may transmit data via a network (not shown) to at least the PCP. In addition, the port side gearbox 118 and the starboard side gearbox 126 may each include a gear feedback indicator 162, 164, respectively. The gear feedback indicators 162, 164 may be third party integrated gear feedback indicators (i.e. installed during manufacture of the gearbox) that rely on a single switch (forward or reverse) feedback from the gearbox 118, 126. The port side gear feedback indicator 162 and the starboard side feedback indicator 164 may be in electronic communication with the PCP 102, and may therefore transmit a signal corresponding to the non-neutral state of the marine vessel 10 transmission to the PCP.

The port side engine ECM 108 and the starboard side engine ECM 110 may include any type of device or any type of component that may interpret and/or execute information and/or instructions stored within a memory 128, 132 to perform one or more functions. Like the PCP 102, the memory 128, 132 of the port and starboard side engine ECMs 108, 110 may include a RAM, a ROM, and/or another type of dynamic or static storage device (e.g., a flash, magnetic, or optical memory) that stores information and/or instructions for use by the port side engine ECM and the starboard side engine ECM. Additionally, or alternatively, the memory may include non-transitory computer-readable medium or memory, such as a disc drive, flash drive, optical memory, read-only memory, or the like. The memory 128, 132 may store the information and/or the instructions in one or more data structures, such as one or more databases, tables, lists, trees, etc. The port side engine ECM 108 and starboard side engine ECM 110 may also include a processor 130, 134 (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software. The port side engine ECM 108 may transmit data via a network (not shown) to at least the PCP 102 and the port side engine 112. Likewise, the starboard side engine ECM 110 may transmit data via a network (not shown) to at least the PCP 102 and the starboard side engine 120.

As noted above, the PCP 102 may be in electronic communication with at least each leverhead control station 40 at each operator station 18, the port side engine ECM 108, the starboard side ECM 110, the port side gearbox 118 and the starboard side gearbox 126 via one or more data links 148. For example, a single data link 148 may be used to communicate with all leverhead control stations 40, and may comprise a Controller Area Network (CAN) bus. Furthermore, the PCP 102 may communicate with the port side engine ECM 108 and the starboard side ECM 110 via data links 150, such as, for example, via J1939 CAN buses. Similarly, each gearbox 118, 126 may also communicate with the PCP 102 via data links 152, such as for example, via J1939 CAN buses.

Referring now to FIG. 3, with continued reference to FIG. 2, the marine propulsion system 100 includes at least one operator station 18, and up to eight operator stations. Each operator station 18 may include at least one leverhead control station 40. The leverhead control station 40 may include a housing 42, a port lever 44, a starboard lever 46, and a user interface 48 including a display screen 50 and at least one display input 52. In this arrangement, the leverhead control station 40 provides throttle and transmission control via the port lever 44 for the port side engine 112 and via the starboard lever 46 for the starboard side engine 120. As illustrated in FIG. 3, the housing 42 may include a set of marks, notches or other type of indicator including a forward position indicator 56, a neutral position indicator 58, and a reverse position indicator 60. While not shown, a second identical set of indicators may also be present on the opposite side of the housing 42 as well. Each of the port lever 44 and starboard lever 46 (only the port lever indicator is illustrated) may include a corresponding lever indicator 62. As illustrated, the lever indicator 62 of the port lever 44 is aligned with the neutral position indicator 58. The indicators 56, 58, 60 may assist the operator of the marine vessel 10 in commanding a gear change (e.g. from neutral to forward or reverse, from reverse to forward, etc.) by aligning the respective port lever indicator 62 with one of the forward position indicator 56, neutral position indicator 58, or reverse position indicator 60.

The leverhead control station 40 may be electronically connected to the PCP 102 via a processor 54 that may be also be electronically coupled to the port lever 44, the starboard lever 46 and the user interface 48. When the marine vessel 10 includes more than one operator station 18, each operator station may be redundant, with each operator station having full system control despite having different physical locations throughout the marine vessel. As such, each operator station 18 may have independent control over both the port powertrain 28 and the starboard powertrain 30.

The user interface 48 of the leverhead control station 40 may be configured in a variety of ways for displaying information related to the operation of the marine propulsion system 100. For example, the at least one display input 52 of the illustrated leverhead control station 40 may include a plurality of buttons A, B, C, D, E; however, the at least one display input may include any type of input device(s). As illustrated, an operator at an active operator station 18 may utilize the buttons A, B, C, D, E in a variety of ways, such as to depress the button to make a selection or to respond to information provided on the display screen 50, or to depress and hold the button for a predetermined period of time to, for example, adjust or set specific operation settings. In an alternative embodiment, for example, the at least one display input 52 and the display screen 50 may be combined into a single device, such as, for example, a touchscreen or the like.

The display screen 50 may be configured to provide a variety of information related to the operation of the marine propulsion system 100, such as, for example, a power, torque, and/or speed of the port side and starboard side engines 112, 120, a power, torque, and/or speed of the port side and starboard side motor-generators 116, 124, a current operating mode of the marine propulsion system, alternative operating modes of the marine propulsion system (such as SYNC, TROLL, SLOW, etc.), as well as various operational parameters, limits, alarms, and warnings, and any other useful information to be displayed to an operator of the marine vessel 10. For example, an alert indicator 64 may be positioned along a top portion of the display screen 50 to alert an operator of the marine vessel 10 to any system errors or mechanical failures. In the illustrated example in FIG. 3, the alert indicator 64 is provided as a diamond with an exclamation point inside, however, it should be understood that this alert may be any shape and color to effectively alert the operator of the marine vessel 10 to a system error or mechanical failure. The alert indicator 64 may also be accompanied by an audial tone or tones that may further attract the attention of the marine vessel 10 operator.

INDUSTRIAL APPLICABILITY

The disclosed marine propulsion system may be applied in a wide variety of marine applications. While the exemplary embodiments of the marine propulsion system are illustrated as a dual engine, dual gearbox, parallel propulsion system, it will be understood that inventive aspects of the disclosed marine propulsion system may be used in propulsion systems having more than or less than two engines and other than parallel arrangements.

As noted above, accurately determining a current gear state (e.g. Forward, Reverse or Neutral) in a marine propulsion control system 100 is imperative during operation of the marine vessel 10. For example, during operation, when an operator of the marine vessel 10 commands a gear change, the actual gear state may not actually change until a series of checks and/or thresholds have been met. To accurately determine those checks and/or thresholds, the PCP 102 may utilize a variety of data to determine the current gear state (hereinafter, "Actual Gear") of the marine vessel 10 prior to permitting a gear change. The PCP 102 determines the Actual Gear by analyzing all available data from at least the following: a Transmission Oil Pressure (TOP), a Commanded Gear (CG), a Forwarded Gear Feedback (FGF), a Reverse Gear Feedback (RGF), a Neutral Gear Feedback (NGF), an In-Gear (i.e. non-Neutral) Feedback (IGF), and a Shaft Direction Gear Feedback (SDGF). Based on this information, the PCP 102 may determine that the Actual Gear of the marine vessel 10 at any given time is one of Reverse, Forward or Neutral. In addition to the data described above, the PCP 102 may also utilize the following data in determining the Actual Gear of the marine vessel 10: a Gear Feedback Installation Status (GFIS), a Port/Starboard Shaft Direction Installation Type (PSSDIT), a Transmission Disengaged Pressure Limit (TDPL) and a Transmission Engaged Pressure Limit (TEPL).

It should be understood that the Actual Gear may be determined for each transmission of the marine vessel 10. A dual engine, dual gearbox, parallel propulsion system is described herein—a system that includes both the port side transmission and the starboard side transmission. As such, the PCP 102 may simultaneously determine an Actual Gear for both the port side transmission and the starboard side transmission. For clarity, the procedure for determining the Actual Gear of the marine vessel 10 is described below with reference to specific components of the port powertrian 28. While not specifically described herein, the data and procedure for determining the Actual Gear of the starboard side transmission is identical to that for determining the Actual Gear of the port side transmission.

The information and data types listed above and used by the PCP 102 are described as follows:

Transmission Disengaged Pressure Limit (TDPL) and a Transmission Engaged Pressure Limit (TEPL)—the TDPL may correspond to a predetermined maximum transmission pressure threshold at which the transmission will become disengaged (i.e. no longer in gear). In one embodiment, the TDPL value may correspond to a pressure between 0 kPa and 4000 kPa. Setting the TDPL to a value of "0" may indicate to the PCP 102 that this data type is disabled. Similarly, the TEPL may correspond to a predetermined minimum transmission pressure at which the transmission will become engaged (i.e. in gear). In one embodiment, the TEPL value may correspond to a pressure between 0 kPa and 4000 kPa. Setting the TEPL to a value of "0" may indicate to the PCP 102 that this data type is disabled.

Transmission Oil Pressure (TOP)—the TOP may correspond to a numerical value corresponding to a pressure of the transmission oil as it is sensed by, for example, the port side transmission oil pressure sensor 158 and the starboard side transmission oil pressure sensor 160. As will be described in more detail below, the PCP 102 may, among other things, compare the TOP with the TDPL and TEPL to determine whether or not the transmission is in gear. More specifically, a TOP value less than the TDPL may provide evidence to the PCP 102 that the transmission is in Neutral gear, and a TOP value greater than the TEPL may provide evidence to the PCP that the transmission is in gear (i.e. not in Neutral). When the TOP is equal to, or between, the TDPL and the TEPL, this may provide evidence to the PCP 102 that the transmission may still be in a last valid gear. The last valid gear may correspond to the last Actual Gear determined by the PCP 102.

Commanded Gear (CG)—the CG corresponds to the gear (Forward, Reverse or Neutral) that may be commanded or desired by the operator of the marine vessel 10 by moving the corresponding port lever 44 or starboard lever 46. As such the value of the CG data type may be one of "Forward," "Reverse," or "Neutral." For example, with reference to FIG. 3, the commanded gear may be Neutral, since the lever indicator 62 is aligned with the neutral position indicator 58. The operator of the marine vessel 10 may command a Forward gear to the port powertrain 28 by moving the port lever 44 in a forward direction to align the lever indicator 62 with the forward position indicator 56. Similarly, the operator of the marine vessel 10 may command a Reverse gear to the port powertrain 28 by moving the port lever 44 in a rearward direction to align the lever indicator 62 with the reverse position indicator 60.

Gear Feedback Installation Status (GFIS), Forward Gear Feedback (FGF), Reverse Gear Feedback (RGF), Neutral Gear Feedback (NGF) and In-Gear (i.e. non-Neutral) Feedback (IGF)—typically, third-party gearbox manufacturers include a set of gear feedback switches or valves that may be configured to provide feedback as to a current gear state. However, the type, number and life-span of the feedback switches varies by manufacturer and model. For example, the gearbox may include no gear feedback switches—in which case the GFIS may have a value of "Not Installed."

In another example, however, the gearbox may be manufactured with a single feedback switch having an "on" position that may indicate the transmission is in gear, and an "off" position indicating the transmission is in Neutral. In this arrangement, the GFIS may have a value of "In Gear" to indicate feedback from that switch is available. When the switch is in the "on" position, the IGF may have a value of "ON," and when the switch is in the "off" position, the IGF may have a value of "OFF."

Finally, in another example, the gearbox may include both forward and reverse feedback switches that may each have "on" and "off" positions. In this arrangement the GFIS may have a value of "FWD/REV" to indicate both forward and reverse gear feedback switches are available. The forward feedback switch may be in the "on" position when the transmission is in the Forward gear, and the reverse feedback switch may be in the "on" position when the transmission is in the Reverse gear, for example. The FGF may have a value of "ON" when the forward feedback switch is in the "on" position, and may have a value of "OFF" when the forward feedback switch is in the "off" position. Similarly, the RGF may have a value of "ON" when the reverse feedback switch is in the "on" position, and may have a value of "OFF" when the reverse feedback switch is in the "off" position. When both the forward and reverse feedback switches are in an "off" position, then the transmission may be in Neutral, and the NGF may have a value of "ON." When either or both of the forward and reverse feedback switches are in an "on" position, the NGF may have a value of "OFF."

Shaft Direction Gear Feedback (SDGF)—the SDGF may correspond to one of a "Forward" value or a "Reverse" value corresponding to a direction of rotation of one of the port side propeller shaft 144 and the starboard side propeller shaft 146 as sensed by the port shaft sensor 154 and starboard shaft sensor 156, respectively.

Port/Starboard Shaft Direction Installation Type (PSSDIT)—the PSSDIT may be used to indicate the availability of the port shaft sensor 154 and/or the starboard shaft sensor 156. The PSSDIT may have a value of "Installed" to indicate data from the respective shaft sensor 154, 156 is available for use by the PCP 102.

Figure 4:
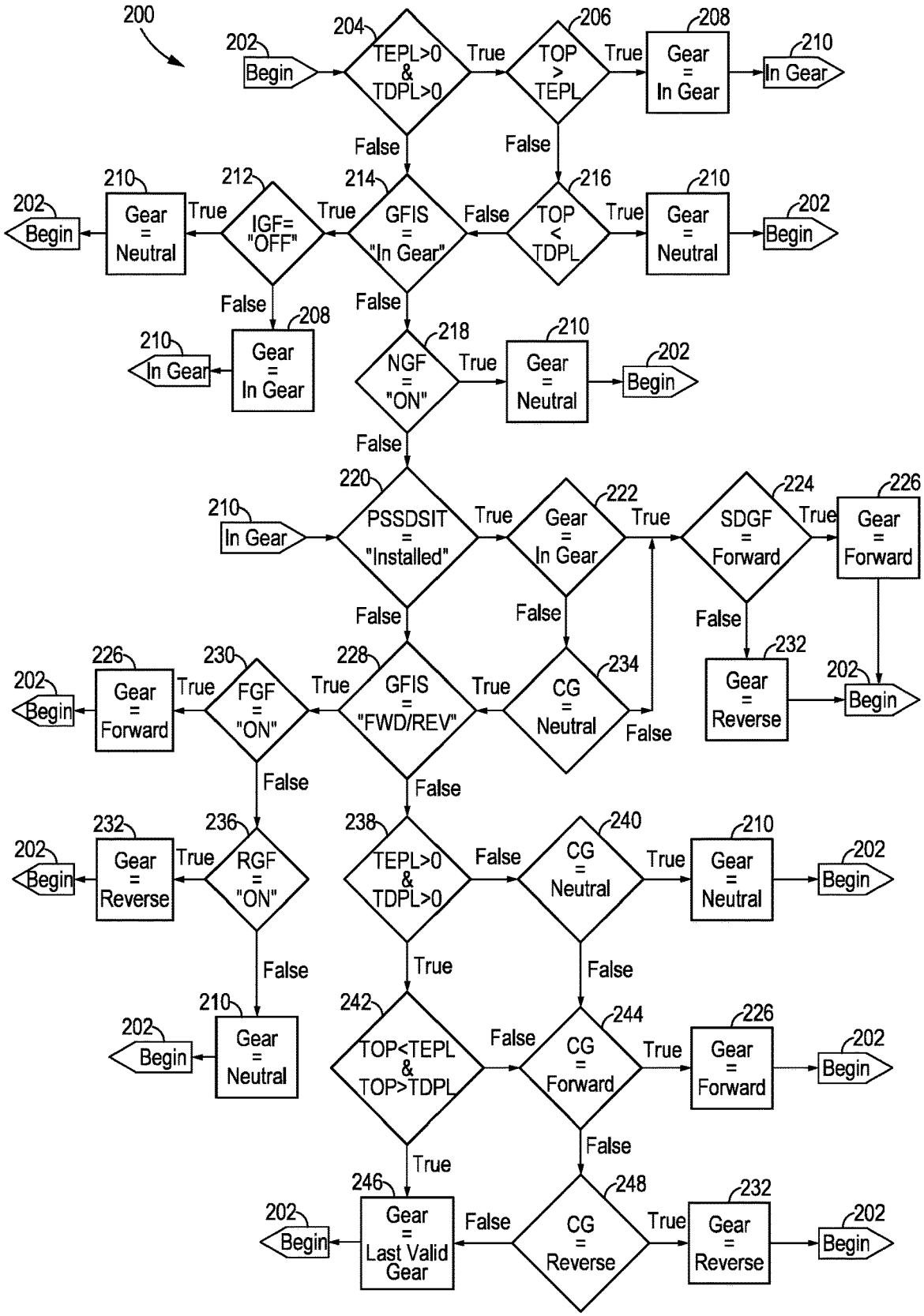
FIG. 4 is a flow chart illustrating an exemplary method of determining a current gear according to an embodiment of the present disclosure.

A series of logic 200, executed by the PCP 102, for determining the Actual Gear of the marine vessel 10 is illustrated in a flowchart format in FIG. 4. Continued reference will also be made to elements illustrated in FIGS. 1-3. In one embodiment, the logic 200 is executed repeatedly in a loop, at least while the marine vessel 10 is in operation.

The process begins at box 202 and proceeds to decision box 204 where the PCP 102 determines whether the TEPL is greater than 0 and the TDPL is greater than 0. If both the TEPL and TDPL are enabled (have values greater than 0), the process moves to box 206. If either the TEPL or TDPL are disabled (have a value of 0), the process moves to box 214. At box 206, the PCP 102 compares the TOP value to the TEPL. If the TOP is greater than the TEPL, then the PCP 102 may determine the transmission to be in gear, a variable Gear is set to a value "In Gear," and the process continues to box 210. In other words, the PCP 102 (in boxes 202, 204 and 206) may determine the transmission is in gear (i.e. not in Neutral) if the transmission oil pressure (TOP) is greater than the predetermined threshold transmission engaged pressure limit (TEPL).

If at box 204 the PCP 102 determines that the TEPL and/or TDPL are disabled, then at decision box 214, the PCP 102 determines whether the value of GFIS is "In Gear." If true, the PCP 102 further determines whether the value of IGF is "OFF" (box 212). If this is also true, the variable Gear is set to a value "Neutral," (box 210) the PCP 102 may set the Actual Gear to Neutral, and the process returns to the beginning box 202. In other words, the PCP 102 (via boxes 202, 204, 214, 212 and 210) may determine the Actual Gear to be Neutral when an In-Gear Feedback (IGF) switch installed in the gearbox 118 is in an "off" position, and transmission oil pressure (TOP) is not available for comparison since the TEPL and/or TDPL are disabled.

If at box 206 the PCP 102 determines that the TOP is less than or equal to the TEPL, the process proceeds to decision box 216. Here, the PCP 102 determines whether the TOP is less than the TDPL. If so, the PCP 102 may set the value of the variable Gear to "Neutral," (box 210) the PCP may determine the Actual Gear to be Neutral, and the process returns to the beginning box 202. In other words, the PCP 102 (via boxes 202, 204, 206, 216 and 210) may determine the Actual Gear to be Neutral when the Transmission Oil Pressure (TOP) is less than the Transmission Disengaged Pressure Limit (TDPL).

If at box 216 the PCP 102 determines the TOP is greater than or equal to the TDPL, the process may proceed toward decision box 214 and continue as described above.

If at box 212 the PCP 102 determines the IGF value is not "OFF," the PCP may set the value of the variable Gear to "In Gear," (box 208) and the process may continue to box 210. In other words, the PCP 102 (via boxes 202, 204, 214, and 212; or via boxes 202, 204, 206, 216, 214 and 212) may determine the transmission to be in gear (i.e. not in Neutral) when an In-Gear Feedback (IGF) switch installed in the gearbox 118 is not in an "off" position, and either the transmission oil pressure (TOP) is not available for comparison or the value of the TOP is both less than or equal to the TEPL and greater than or equal to the TDPL.

If at box 214 the PCP 102 determines the GFIS value is something other than "In Gear," the process proceeds to box 218. Here, the PCP 102 determines whether the NGF value is "ON." If true, then the PCP 102 may set the value of the variable Gear to "Neutral," (box 210) the PCP may determine the Actual Gear to be Neutral, and the process returns to the beginning box 202. In this example, the PCP 102 may determine (via boxes 202, 204, 214 and 218; or via boxes 202, 204, 206, 216, 214 and 218) the Actual Gear to be Neutral because a Neutral Gear Feedback (NGF) switch installed in the gearbox 118 is in an "on" position, and either the transmission oil pressure (TOP) is not available for comparison or the value of the TOP is both less than or equal to the TEPL and greater than or equal to the TDPL.

If at box 218 the PCP 102 determines the NGF value is not equal to "ON," then the process proceeds to box 220. Similarly, the PCP 102 may also reach decision box 220 via a determination that the transmission is in gear (e.g. via box 208). At decision box 220, the PCP 102 determines whether the PSSDSIT is set to a value of "Installed." If true, then the process proceeds to decision box 222, where the PCP 102 determines whether the value of the variable Gear is set to "In Gear." If this is also true, then the process proceeds to decision box 224, where the PCP 102 determines whether the SDGF is set to a value "Forward," in which case the PCP 102 sets the value of the variable Gear to "Forward," (box 226) determines the Actual Gear to be Forward, and the process returns to the beginning box 202. In this situation, the PCP 102 may make the determination that the Actual Gear is Forward because the rotational direction of the propeller shaft (e.g. port side propeller shaft 144) is rotating in a forward direction, and either the transmission oil pressure is greater than the transmission engaged pressure limit or the transmission oil pressure is greater than or equal to the transmission disengaged pressure limit and an in-gear feedback switch indicates the transmission is in gear. The PCP 102 may also determine the Actual Gear is Forward, even when the TDPL and TEPL are disabled, by determining the Neutral Gear Feedback (NGF) switch is "off" and determining the rotational direction of the propeller shaft is the forward direction.

If at decision box 224 the PCP 102 determines the SDGF value is not "Forward," the PCP may set the value of the variable Gear to "Reverse," (box 232) may determine the Actual Gear to be Reverse, and the process returns to the beginning box 202. In this situation, the PCP 102 may make the determination that the Actual Gear is Reverse because the rotational direction of the propeller shaft (e.g. port side propeller shaft 144) is rotating in a reverse direction, and either the transmission oil pressure is greater than the transmission engaged pressure limit or the transmission oil pressure is greater than or equal to the transmission disengaged pressure limit and an in-gear feedback switch indicates the transmission is in gear. The PCP 102 may also determine the Actual Gear is Reverse, even when the TDPL and TEPL are disabled, by determining the Neutral Gear Feedback (NGF) switch is "off" and determining the rotational direction of the propeller shaft is the reverse direction.

If at decision box 222, the value of the variable Gear is not "In Gear," the process proceeds to decision box 234, at which point the PCP 102 determines whether the CG is Neutral. If the commanded gear (CG) is not Neutral, then the process proceeds to decision box 224 as described above. If the CG is Neutral, then the process proceeds to decision box 228 and proceeds as described below.

If at decision box 220, the PCP 102 determines the PSSDSIT value is not "Installed," the process proceeds to box 228. At decision box 228, the PCP 102 may determine whether the GFIS value is "FWD/REV." If true, then the process proceeds to box 230, when the PCP 102 may determine whether the FGF value is "ON." If also true, the PCP 102 sets the value of the variable Gear to "Forward," (box 226) determines the Actual Gear to be Forward, and the process returns to the beginning box 202. In other words, the PCP 102 may determine the Actual Gear to be Forward when a Forward Gear Feedback (FGF) switch indicates the transmission is operating in a forward gear, and either the transmission oil pressure is greater than the transmission engaged pressure limit or the transmission oil pressure is greater than or equal to the transmission disengaged pressure limit and an in-gear feedback switch indicates the transmission is in gear. The PCP 102 may also determine the Actual Gear is Forward, even when the TDPL and TEPL are disabled, by determining the Neutral Gear Feedback (NGF) switch is "off" and determining the Forward Gear Feedback (FGF) is "on."

If at decision box 230, the PCP 102 determines the FGF value is not "ON," the process proceeds to decision box 236, where the PCP evaluates whether the value of RGF is "ON." If true, the PCP 102 sets the value of the variable Gear to "Reverse," (box 232) determines the Actual Gear to be Reverse, and the process returns to the beginning box 202. In other words, the PCP 102 may determine the Actual Gear to be Reverse when a forward gear feedback switch indicates the transmission is not operating in a forward gear, the reverse gear feedback switch (e.g. port side gear feedback indicator 162) indicates the transmission is operating in a reverse gear, and either the transmission oil pressure is greater than the transmission engaged pressure limit or the transmission oil pressure is greater than or equal to the transmission disengaged pressure limit and an in-gear feedback switch indicates the transmission is in gear. The PCP 102 may also determine the Actual Gear is Reverse, even when the TDPL and TEPL are disabled, by determining both the Neutral Gear Feedback (NGF) switch and Forward Gear Feedback (FGF) switches are "off", but the Reverse Gear Feedback (RGF) switch is "on."

If at decision box 236, the PCP 102 determines the RGF value is not "ON," the PCP 102 sets the value of the variable Gear to "Neutral," (box 210) determines the Actual Gear to be Neutral, and the process returns to the beginning box 202. In other words, the PCP 102 may determine the Actual Gear to be Neutral when both the forward gear feedback switch and the reverse gear feedback switch (e.g. port side gear feedback indicator 162) are switched "off," and either the transmission oil pressure is greater than the transmission engaged pressure limit or the transmission oil pressure is greater than or equal to the transmission disengaged pressure limit and an in-gear feedback switch indicates the transmission is in gear. The PCP 102 may also determine the Actual Gear is Neutral, even when the TDPL and TEPL are disabled and the Neutral Gear Feedback (NGF) switch is "off," by determining both the forward gear feedback switch and the reverse gear feedback switch are also "off."

If at decision box 228, the PCP 102 determines the value of GFIS is not "FWD/REV," the process proceeds to decision box 238 to determine (as in box 204) whether the TEPL and TDPL have values above 0. If the TEPL or TDPL are disabled (i.e. have 0 values), then the process proceeds to box 240. If the PCP 102 determines (box 240) the CG is Neutral, then the PCP sets the value of the variable Gear to "Neutral," (box 210) determines the Actual Gear to be Neutral, and the process returns to the beginning box 202. In other words, the PCP 102 may determine the Actual Gear to be Neutral when one or more of the transmission oil pressure limits (TEPL or TDPL) are disabled, no data is available from the gear feedback switches, no directional rotation data is available for the propeller shaft, and a commanded gear from an operator of the marine vessel 10 is "Neutral." This hierarchy enables the commanded gear to take precedence when information and data related to transmission oil pressure, feedback gear switches and shaft rotation is unavailable.

Along the same lines, if at box 244 the PCP 102 determines the commanded gear (CG) is Forward, rather than Neutral or Reverse, the PCP sets the value of the Gear variable to Forward (box 226), determines the Actual Gear to be Forward, and the process returns to the beginning box 202. Similarly, if at box 248 the PCP 102 determines the commanded gear (CG) is Reverse, rather than Neutral or Forward, the PCP sets the value of the Gear variable to Reverse (box 232), determines the Actual Gear to be Reverse, and the process returns to the beginning box 202.

If at box 238 the PCP 102 determines the values of the TEPL and the TDPL are greater than zero (i.e. enabled), the process proceeds to box 242. Here, the PCP 102 compares the value of the TOP to the TEPL and TDPL. If the TOP is not less than the TEPL or the TOP is not greater than the TDPL, the process proceeds to box 244 as described above. Conversely, if the TOP is less than the TEPL and greater than the TDPL, the PCP 102 sets the value of the Gear variable to the last valid gear—one of Neutral, Reverse or Forward (box 246) and the process returns to the beginning box 202. In this example, the value of the Actual Gear is maintained from a previous value.

If at any point during the process 200, the PCP 102 determines any data available to the PCP, including, but not limited to gear feedback, transmission oil pressure, shaft direction, and commanded gear, are inconsistent with each other longer than a predetermined period of time (e.g. 2 seconds), the alert indicator 64 may be displayed on the display screen 50 to the operator of the marine vessel 10. Contradicting and inconsistent data may indicate that one or more of the sensory mechanisms (e.g. the gear feedback indicators 162, 164, the transmission oil pressure sensors 160, 158, the shaft sensors 154, 156, and the commanded gear), its circuitry and/or its harness has failed, since the marine vessel 10 cannot operate simultaneously in different gears. For example, if the TOP value is less than the TDPL (indicating a neutral gear state), but the FGF indicator is "ON" (indicating a forward gear state), then the alert indicator 64 should be displayed to the operator as the marine vessel 10 cannot operate in both a forward gear and a neutral gear simultaneously.

While a series of steps and operations have been described herein, those skilled in the art will recognize that these steps and operations may be re-arranged, replaced, eliminated, or performed simultaneously without departing from the spirit and scope of the present disclosure as set forth in the claims.

In addition, while aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. A marine propulsion control system for use with a marine vessel, the marine propulsion control system comprising:

an engine in electronic communication with an engine controller;

a transmission including a gearbox and an oil pressure sensor configured to measure a transmission oil pressure, the oil pressure sensor in electronic communication with the engine controller, the gearbox including a feedback sensor configured to transmit a gear state;

a propulsion device rotatably connected to the gearbox;

a shaft fixedly attached to the propulsion device and rotatably coupled to the gearbox, the shaft including a shaft rotation sensor configured to measure a rotational direction of the shaft; and a propulsion control processor in electronic communication with the engine controller, the shaft rotation sensor and the gearbox, the propulsion control processor configured to determine a current gear of the marine vessel is neutral when the transmission oil pressure is below a predetermined transmission disengaged pressure threshold, and determine a current gear of the marine vessel is forward or reverse based on the transmission oil pressure being above a predetermined transmission engaged pressure threshold and one of the gear state or the rotational direction of the shaft.

2. The marine propulsion control system of claim 1, in which in absence of the gear state, the the propulsion control processor configured to determine a current gear of the marine vessel is the last valid gear when the transmission oil pressure is between the disengaged pressure threshold and the engaged pressure threshold.

3. The marine propulsion control system of claim 1, further including an operator station having a lever configured to control a throttle of the engine, wherein a position of the lever defines a commanded gear, wherein the commanded gear is one of forward, reverse and neutral.

4. The marine propulsion control system of claim 3, wherein the propulsion control processor is further configured to determine the current gear of the marine vessel based on the commanded gear and one or more of the gear state, the transmission oil pressure, and the rotational direction of the shaft.

5. The marine propulsion control system of claim 3, wherein the oil pressure sensor, the feedback sensor and the shaft rotation sensor may each be enabled or disabled, and wherein when each of the oil pressure sensor, the feedback sensor and the shaft rotation sensor are disabled, then the current gear of the vessel corresponds to the commanded gear.

6. The marine propulsion control system of claim 1, wherein the propulsion control processor determines the current gear of the marine vessel by comparing the transmission oil pressure with the predetermined transmission engaged pressure threshold and the predetermined transmission disengaged pressure threshold when the engaged pressure threshold is greater than 0 and the disengaged pressure threshold is greater than 0.

7. The marine propulsion control system of claim 6, wherein when the transmission oil pressure is less than or equal to the transmission engaged pressure threshold and less than the transmission disengaged pressure threshold, the current gear of the vessel is neutral.

8. The marine propulsion control system of claim 1, wherein the gear state is one of forward, reverse, in gear and neutral.

9. A marine vessel, the marine vessel comprising:
a hull;
an operator station; and
a marine propulsion control system, including:
an engine in electronic communication with an engine controller,
a transmission including a gearbox and an oil pressure sensor configured to measure a transmission oil pressure, the oil pressure sensor in electronic communication with the engine controller, the gearbox including a feedback sensor configured to transmit a gear state,
a propulsion device rotatably connected to the gearbox,
a shaft fixedly attached to the propulsion device and rotatably coupled to the gearbox, the shaft including a shaft rotation sensor configured to measure a rotational direction of the shaft, and
a propulsion control processor in electronic communication with the engine controller, the gearbox and the shaft rotation sensor, the propulsion control processor configured to:
receive the transmission oil pressure, the gear state of the transmission and the rotational direction of the shaft,
compare the transmission oil pressure with a predetermined engaged pressure threshold, wherein when the transmission oil pressure is greater than the predetermined engaged pressure threshold, the propulsion control processor is further configured to analyze one or more of the gear state and the direction of rotation to determine a current gear of the marine vessel, and
when the transmission oil pressure is less than or equal to the engaged pressure threshold, compare the transmission oil pressure with a predetermined disengaged pressure threshold, wherein when the transmission oil pressure is greater than or equal to the transmission disengaged pressure threshold, the propulsion control processor is configured to analyze one or more of the gear state and the direction of rotation to determine the current gear of the marine vessel.

10. The marine vessel of claim 9, wherein the operator station includes a lever configured to control a throttle of the engine, wherein a position of the lever defines a commanded gear, wherein the commanded gear is one of forward, reverse and neutral.

11. The marine vessel of claim 10, wherein the propulsion control processor is further configured to receive the commanded gear.

12. The marine vessel of claim 9, wherein when the transmission oil pressure is less than or equal to the transmission engaged pressure threshold and the transmission oil pressure is greater than or equal to the transmission disengaged pressure threshold, the current gear of the marine vessel is neutral.

13. The marine vessel of claim 9, wherein the current gear of the marine vessel is one of neutral, forward and reverse.

14. The marine vessel of claim 9, wherein the feedback sensor is an in-gear feedback sensor, wherein the gear state is one of on and off, wherein when the gear state is off, the transmission is in neutral, and when the gear state is on, the transmission is in one of forward and reverse.

15. The marine vessel of claim 9, wherein the operator station includes a display screen to an operator of the marine vessel.

16. The marine vessel of claim 15, further including a forward gear feedback sensor configured to transmit an on signal to indicate the transmission is in a forward gear and an off signal to indicate the transmission is in a reverse gear, and a reverse gear feedback sensor configured to transmit an on signal to indicate the transmission is in the reverse gear and an off signal to indicate the transmission is in the reverse gear.

17. The marine vessel of claim 16, wherein the rotational direction of the shaft is one of forward and reverse.

18. The marine vessel of claim 15, wherein when the propulsion control processor determines the current gear is more than one of forward, reverse and neutral, an alert indicator is displayed on the display screen to the operator of the marine vessel.

19. A method of determining a current gear of a marine vessel, the marine vessel including a transmission and a propulsion control processor to execute the method, the method comprising:
determining whether a transmission oil pressure sensor is enabled or disabled;
receiving, if the transmission oil pressure sensor is enabled, an oil pressure;
determining if a feedback sensor is installed in a gearbox of a transmission of the marine vessel;
receiving, if the feedback sensor is installed, a gear state of the transmission;
determining if a shaft rotational direction sensor is installed on a shaft of a propulsion device of the marine vessel;
receiving, if the shaft rotational direction sensor is installed, a direction of rotation of the shaft; and
receiving a commanded gear, the commanded gear being set by an operator of the marine vessel, wherein, upon receipt of the oil pressure, the gear state, the direction of rotation of the shaft and the commanded gear, the propulsion control processor first compares the oil pressure with a predetermined pressure threshold to determine whether the current gear is neutral or one of forward and reverse, the propulsion control process then compares one or more of the gear state, the direction of rotation, and the commanded gear based on the first comparison to determine whether the current gear is one of neutral, forward and reverse.

20. The method of claim 19, wherein the current gear of the marine vessel is determined to be the commanded gear when the transmission oil pressure sensor is disabled, the feedback sensor is not installed, and the shaft rotational direction sensor is not installed.

* * * * *